US006405707B1

(12) United States Patent
Feucht

(10) Patent No.: US 6,405,707 B1
(45) Date of Patent: Jun. 18, 2002

(54) INTEGRAL ENGINE AND ENGINE COMPRESSION BRAKING HEUI INJECTOR

(75) Inventor: Dennis D. Feucht, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/739,420

(22) Filed: Dec. 18, 2000

(51) Int. Cl.[7] ..... F02D 13/04; F02M 55/00; F01L 13/06

(52) U.S. Cl. ..... 123/321; 123/446

(58) Field of Search ..... 123/320, 321, 123/322, 323, 324, 446, 447, 501, 90.12, 90.13, 90.16

(56) References Cited

U.S. PATENT DOCUMENTS

| | | | | | |
|---|---|---|---|---|---|
| 3,367,312 | A | | 2/1968 | Jonsson | |
| 4,572,114 | A | * | 2/1986 | Sickler | 123/321 |
| 4,602,604 | A | | 7/1986 | Kauer | |
| 4,706,624 | A | | 11/1987 | Meistrick et al. | |
| 4,711,210 | A | | 12/1987 | Reichenbach | |
| 4,836,171 | A | | 6/1989 | Melde-Tuczai et al. | |
| 5,117,790 | A | * | 6/1992 | Clarke et al. | 123/321 |
| 5,161,501 | A | * | 11/1992 | Hu | 123/321 |
| 5,191,867 | A | * | 3/1993 | Glassey | 123/446 |
| 5,237,976 | A | | 8/1993 | Lawrence et al. | |
| 5,495,838 | A | | 3/1996 | Johnson, Jr. | |
| 5,507,261 | A | | 4/1996 | Johnson, Jr. | |
| 5,537,975 | A | * | 7/1996 | Cosma et al. | 123/322 |
| 5,540,207 | A | | 7/1996 | Absenger | |
| 5,564,386 | A | * | 10/1996 | Korte et al. | 123/321 |
| 5,609,133 | A | | 3/1997 | Hakansson | |
| 5,645,031 | A | | 7/1997 | Meneely | |
| 5,730,101 | A | * | 3/1998 | Aupperle | 123/321 |
| 5,735,242 | A | * | 4/1998 | Kahlenbeck et al. | 123/322 |
| 5,794,590 | A | * | 8/1998 | Bergmann | 123/321 |
| 5,894,830 | A | * | 4/1999 | Blass et al. | 123/446 |
| 6,283,090 | B1 | * | 9/2001 | Harmon | 123/321 |

* cited by examiner

*Primary Examiner*—Willis R. Wolfe
(74) *Attorney, Agent, or Firm*—Larry G. Cain

(57) ABSTRACT

An integral engine fueling and engine compression braking hydraulically actuated, electronically controlled unit injector (HEUI) system comprises a fuel injection piston. A brake rocker arm extends transversely through the fuel injector and axially accommodates the fuel injector plunger and plunger return spring. The brake rocker arm is also operatively connected to the engine exhaust valve rocker arm, and a camming shaft, having a flat or planar surface portion, is operatively connected to an end portion of the brake rocker arm. When the end portion of the brake rocker arm is disposed in contact with the flat or planar surface portion of the camming shaft, normal fuel injection can occur in accordance with an electronic control module (ECM). When the electronic control module (ECM) actuates a servomechanism for rotating the camming shaft such that the end portion of the brake rocker arm is disposed in contact with a curved portion of the camming shaft, a brake actuation sleeve, mounted upon the brake rocker arm, engages the fuel injection piston such that upon actuation of the fuel injection piston, the brake rocker arm causes the exhaust valve rocker arm to actuate the exhaust valve so as to achieve engine compression braking.

19 Claims, 2 Drawing Sheets

INTEGRAL ENGINE AND ENGINE COMPRESSION BRAKING HEUI INJECTOR

TECHNICAL FIELD

The present invention relates generally to internal combustion engines, and more particularly to a structural system which permits the engine fuel injector plunger piston to in effect control actuation of one or more of the engine exhaust valves so as to achieve compression braking of the engine.

BACKGROUND ART

In order to achieve compression braking, it is usually required to incorporate into the structural operating system various auxiliary operating components, such as, for example, pumps or other similar pumping or actuating mechanisms in order to appropriately control the engine exhaust valve which will be actuated in order to achieve the compression braking mode of the engine. The incorporation of such auxiliary actuating components into the structural operating system of the engine, however, in order to achieve the compression braking operating mode of the engine, adds substantially to the overall engine costs.

The present invention is directed to overcome on or more of the problems as set forth above.

DISCLOSURE OF THE INVENTION

The foregoing need is achieved in accordance with the principles and teachings of the present invention through the provision of a new and improved internal combustion engine fueling and compression braking hydraulically actuated, electronically controlled unit injector (HEUI) mechanism or system which comprises an engine cylinder; a fuel injector for injecting fuel into the engine cylinder such that the fuel can be combusted; a piston for causing pressurization of the fuel to be delivered to the fuel injector; an exhaust valve operatively associated with the engine cylinder for controlling the exhaust of gaseous products from the engine cylinder; an exhaust valve rocker arm operatively connected to the exhaust valve so as to control the opening of the exhaust valve when the exhaust of gaseous products from the engine cylinder is desired; a compression brake actuating system for operatively interconnecting the piston to the exhaust valve rocker arm; and a control system operatively connected to the compression brake actuating system for alternatively disposing the compression brake actuating system in two different operative modes wherein when the compression brake actuating system is disposed in a first one of the two different operative modes, the compression brake actuating system is operatively disconnected from the piston such that movement of the piston causes normal engine fuel injection to occur, and wherein when the compression brake actuating system is disposed in a second one of the two different operative modes, the compression brake actuating system is operatively connected to the piston such that movement of the piston causes the compression brake actuating system to actuate the exhaust valve rocker arm so as to in turn actuate the exhaust valve such that compression braking can occur.

BEST MODE FOR CARRYING OUT THE INVENTION

Figure 1:
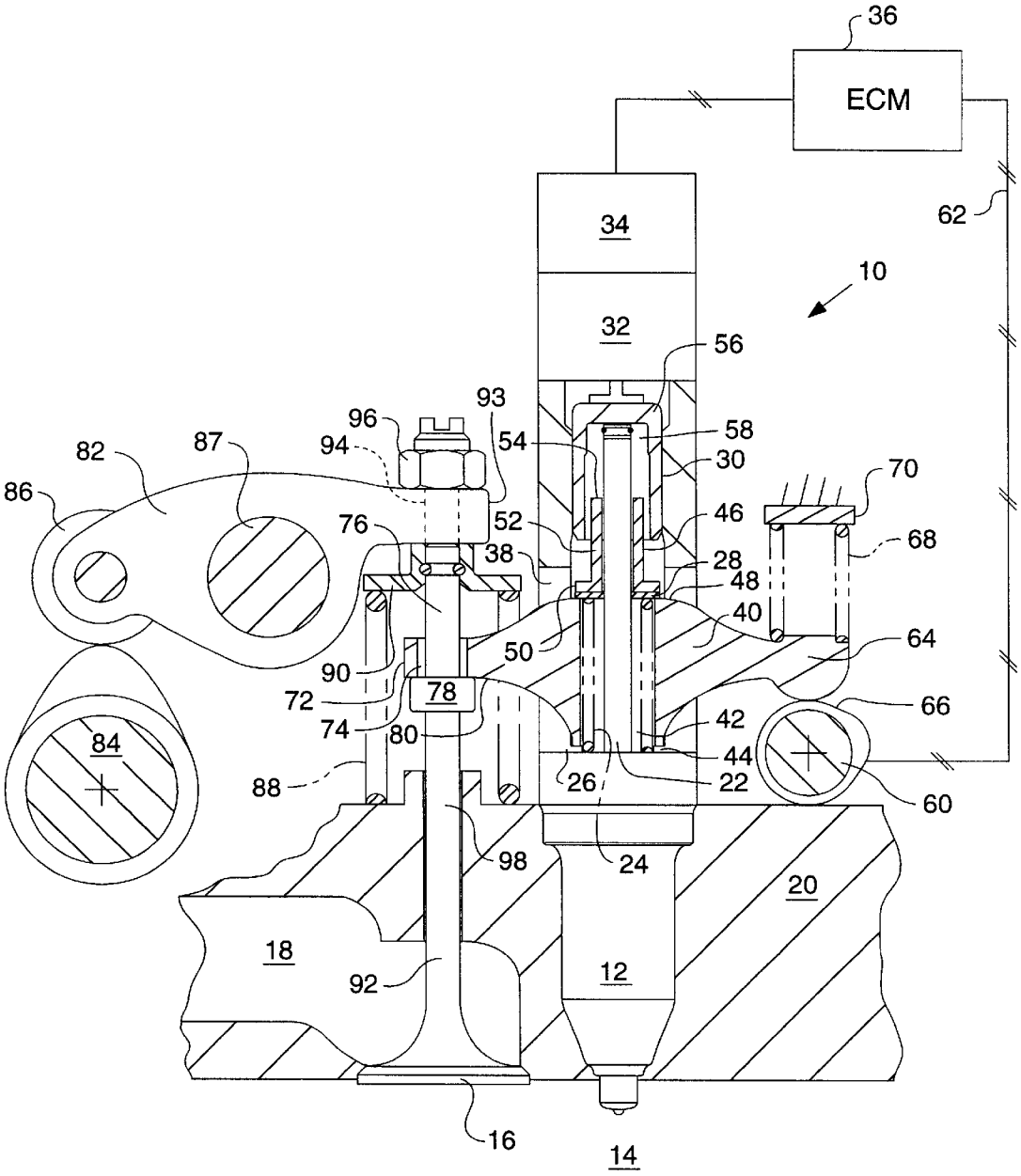
FIG. 1 is a schematic cross-sectional view of an embodiment of an internal combustion engine fueling and compression braking hydraulically actuated, electronically controlled unit injector (HEUI) mechanism or system constructed showing the cooperative parts thereof.

Referring now to the drawings, and more particularly to FIG. 1 thereof, there is disclosed an embodiment of an internal combustion engine fueling and compression braking hydraulically actuated, electronically controlled unit injector (HEUI) mechanism or system which is constructed in accordance with the principles and teachings of the present invention and which is generally indicated by the reference character 10. As disclosed in FIG. 1, the injector mechanism or system 10 has a fuel injector member or element 12 for injecting fuel into an engine cylinder 14 which has operatively associated therewith an exhaust valve 16 for controlling the discharge of exhaust gases from the cylinder 14 through an exhaust passage or exhaust port 18 which is defined within a cylinder head 20.

As is conventional, the fuel injector member or element 12 has operatively associated therewith a plunger mechanism or element 22 which controls the intake and pressurization of fuel to the fuel injector member or element 12. The plunger mechanism or element 22 has a plunger return spring 24 operatively associated therewith so as to bias the plunger mechanism or element 22 upwardly. During the upward stroke, fuel is ingested into the fuel injector member or element 12 through a fuel supply port, not shown. The bottom or lower end of the plunger return spring 24 is seated upon a support platform or plate 26 of the fuel injector member or element 12. The top or upper end of the plunger return spring 24 is engaged with an annular collar 28 fixedly mounted upon an axially central portion of the plunger mechanism or element 22.

The upper end portion of the plunger mechanism or element 22 is engaged with a substantially inverted U-shaped or cup-shaped piston 30. The piston 30 is fluidically or hydraulically connected to an injector control valve 32 which controls hydraulic fluid or oil to the piston 30. The injector control valve 32 is, in turn, electronically connected to a solenoid 34. And, an electronic control module (ECM) 36 is electronically connected to the solenoid 34. The electronic control module (ECM) 36 controls the timing and duration of the period during which the solenoid 34 is energized or activated which, in turn, controls the opening and closing of the injector control valve 32 so as to permit or terminate the supply of hydraulic fluid or oil to the piston 30.

The fuel injector member or element 12 is provided with a transversely or radially disposed passage or through-slot 38 through or within which there is transversely disposed a brake rocker arm 40. The brake rocker arm 40 similarly has a centrally located, axially oriented passage or through-slot 42 which and within which the fuel injector plunger 22 and the plunger return spring 24 are respectively axially disposed and accommodated. The lower or bottom portion 44 of the brake rocker arm 40 is adapted to be seated atop or upon the support platform or plate 26 of the fuel injector member or element 12. A tubular brake actuation sleeve 46 is adapted to be seated upon or atop an upper or top surface region of a central portion 48 of the brake rocker arm 40.

The tubular brake actuation sleeve 46 has a flanged or headed portion 50 which is adapted to be seated upon or atop the upper or top surface region of the central portion 48 of the brake rocker arm 40. A tubular shank portion 52 is concentrically or coaxially disposed around the upper axial end of the fuel injector plunger 22. The axially upper end portion of the tubular shank portion 52 is disposed concentrically or coaxially within the lower end portion of the fuel injector piston 30. The uppermost or distal end portion 54 of the tubular shank portion 52 of the brake actuation sleeve 46 is spaced from the upper transversely disposed base portion 56 of the fuel injector piston 30 as shown at 58. During a normal fuel injection mode, as determined by the electronic control module (ECM) 36, the brake actuation sleeve 46 is simply disposed atop the brake rocker arm 40 and does not interfere with the axially downward movement of the fuel injector piston 30.

With reference continuing to be made to FIG. 1, a cam shaft 60 is rotatably disposed upon or fixed at a predetermined vertical position with respect to the upper surface of the engine cylinder head 20. The cam shaft 60 is operatively connected to the electronic control module (ECM) 36 as shown at 62 such that the electronic control module (ECM) 36 can control the rotational or pivotal disposition of the cam shaft 60, for example, by a suitable servomechanism, not shown. As viewed in FIG. 1, brake rocker arm 40 has a right end portion 64 which is normally disposed in contact with a flattened or planar portion 66 of the cam shaft 60. In order to maintain the right end portion 64 of the brake rocker arm 40 in contact with the flattened or planar portion 66 of the camming shaft 60, a biasing spring 68 is interposed the upper surface section of the right end portion 64 of the brake rocker arm 40 and an engine support surface 70.

Brake rocker arm 40 has a left end portion 72 which is provided with a bore 74 through which an adjustable braking rod 76 extends. The lower end portion of the adjustable braking rod 76 is provided with a head or collar portion 78 which engages an undersurface portion 80 of the left end portion 72 of the brake rocker arm 40. An exhaust valve rocker arm 82 is provided for conventionally controlling the opening of the engine exhaust valve 16 in response to actuation of the exhaust valve rocker arm 82. The engine camshaft 84 acts upon a roller member 86 disposed upon a left end portion of the exhaust valve rocker arm 82. The camshaft 84 pivots or rotates the exhaust valve rocker arm 82 in the clockwise direction around its rocker arm shaft 87. And in a reverse manner, the closing of the engine exhaust valve 16 is achieved by an exhaust valve return spring 88.

As can be seen from FIG. 1, the lower end portion of the exhaust valve return spring 88 is seated upon or atop the cylinder head 20. The upper end portion of the exhaust valve return spring 88 is engaged with a collar 90 which is fixed upon an upper end portion, not shown, of the engine exhaust valve stem 92. The engine exhaust valve stem 92 is actually disposed behind the adjustable braking rod 76 operatively associated with the brake rocker arm 40. The upper end portion, not shown, of the engine exhaust valve stem 92 is disposed within the right end portion 93 of the exhaust rocker arm 82 of a suitable fixture assembly, also not shown. The right end portion 93 of the exhaust rocker arm 82 is disposed in contact with the collar portion 90 as a result of the upward biasing of the collar portion 90 of the exhaust valve return spring 88.

In a similar manner, exhaust rocker arm 82 is provided with a through-bore 94 through which the upper end portion of the adjustable braking rod 76 is disposed. An adjustment nut 96 is threadedly engaged with the upper end portion of the adjustable braking rod 76 and is seated upon or atop the exhaust rocker arm 82. Thus, to properly adjust the disposition of the adjustable braking rod 76, and in particular, its collar portion 78, with respect to the brake rocker arm 40, the collar portion 78 of the adjustable braking rod 76 must be properly engaged with the lower undersurface or underside portion 80 of the brake rocker arm 40.

It is to be further appreciated that the upper end portion of the adjustable braking rod 76 and the through-bore 94 provided within the exhaust valve rocker arm 82 are predeterminedly sized with respect to each other. When the camshaft 84 actuates the exhaust valve rocker arm 82 causing the exhaust valve rocker arm 82 to pivot in a clockwise manner, with respect to its rocker arm shaft 87, causing the engine exhaust valve 16 to open during a normal exhaust mode of the engine, there is no corresponding actuation or movement of the adjustable braking rod 76 or the brake rocker arm 40. To the contrary, when the brake rocker arm 40 is actuated, as will be described more in detail hereinafter, the downward and counterclockwise movement of the brake rocker arm 40 will be transmitted to the exhaust valve rocker arm 82 by the collar portion 78 and the nut 96 of the adjustable braking rod 76. The actuation causes clockwise pivotal movement of the exhaust valve rocker arm 82 with respect to its rocker arm shaft 87. The engine exhaust valve 16, in turn, is caused to be opened by the connection between the exhaust valve rocker arm 82 and the stem portion 92 of the engine exhaust valve 16. The cylinder head 20 is provided with a stop member 98 which is normally spaced from collar portion 78 of the adjustable braking rod 76. The stop member 98 limits the downward and counterclockwise movement of the left end portion 72 of the brake rocker arm 40 as a result of the collar portion 78 of the adjustable braking rod 76 engaging the stop member 98.

Figure 2:
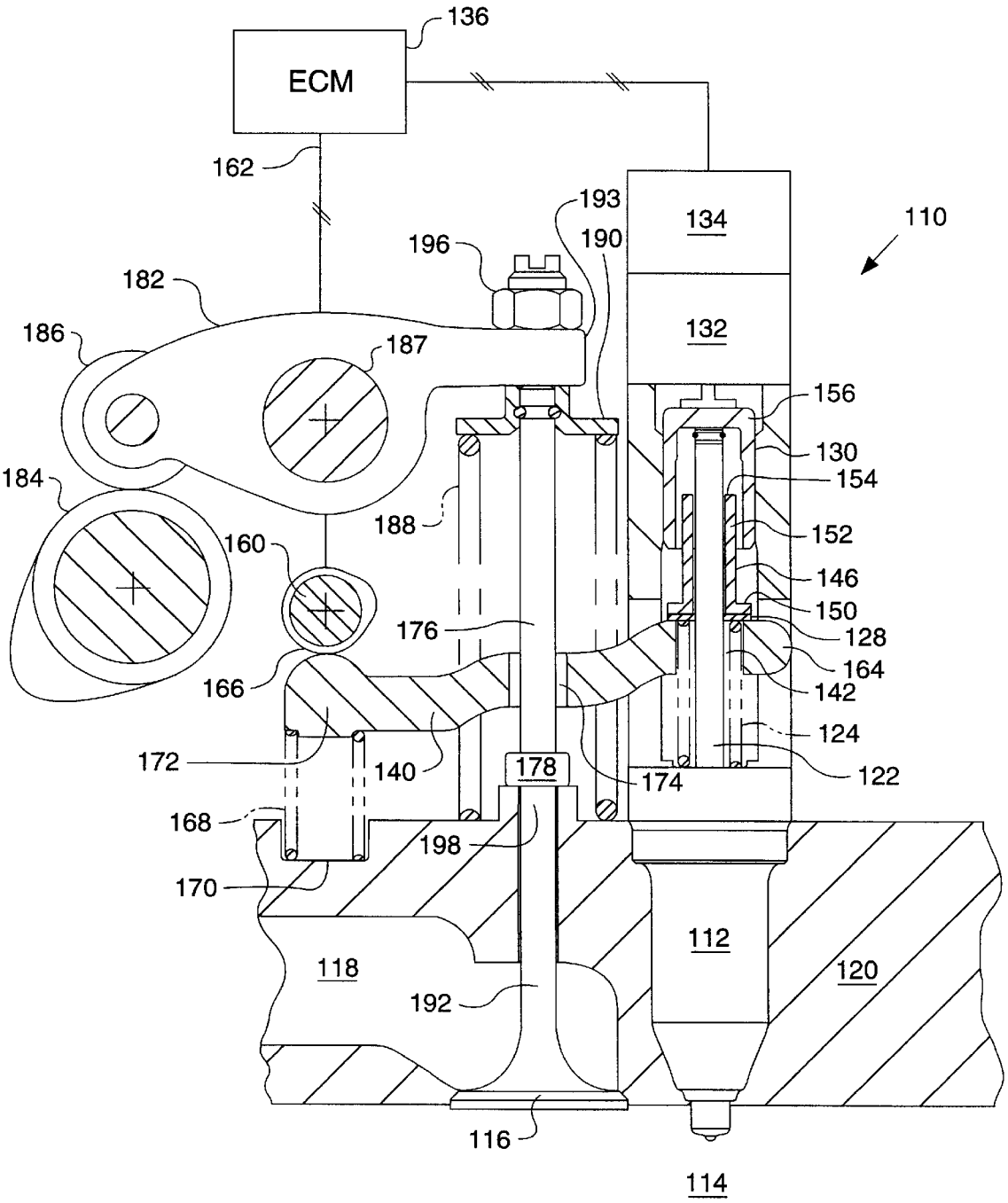
FIG. 2 is a schematic cross-sectional view similar to that of FIG. 1 showing, however, another embodiment of an internal combustion engine fueling and compression braking hydraulically actuated, electronically controlled unit injector (HEUI) mechanism or system constructed showing the cooperative parts thereof.

With reference now being made to FIG. 2, another embodiment of the internal combustion engine fueling and compression braking hydraulically actuated, electronically controlled unit injector (HEUI) mechanism or system is generally indicated by the reference character 110. The internal combustion engine fueling and compression braking hydraulically actuated, electronically controlled unit injector (HEUI) mechanism or system 10 of the present invention as disclosed in FIG. 1 are designated by similar reference characters except that the reference characters designating the various components of the mechanism or system 110 of the present invention as disclosed within FIG. 2 will be within the 100 series.

The internal combustion engine fueling and compression braking hydraulically actuated, electronically controlled unit injector (HEUI) mechanism 10 of the present invention as disclosed in FIG. 1, however, it is to be appreciated that the arrangement of such component parts of the embodiment system or mechanism 110 shown in FIG. 2 is somewhat different than that arrangement of the component parts of the first embodiment system or mechanism 10 of FIG. 1. Accordingly, the following discussion and description of the embodiment system or mechanism 110 as disclosed within FIG. 2 will focus only upon such different arrangement of the noted component parts of the system or mechanism 110.

With reference therefore being made to FIG. 2, the embodiment of the internal combustion engine fueling and compression braking hydraulically actuated, electronically controlled unit injector (HEUI) mechanism or system 10 disclosed within FIG. 1 except for the arrangement or relative disposition of the brake rocker arm 140 with respect to the fuel injector plunger 122, the adjustable braking rod 176, and the camming shaft 160. For example, it is readily apparent that, in lieu of the cam shaft 60 being disposed remote from the exhaust rocker arm 82 and the cam shaft 84 and being disposed upon one side of the fuel injector 12 and the fuel injector plunger mechanism 22. The exhaust rocker arm 82 and the cam shaft 84 are disposed upon the opposite side of the fuel injector 12 and the fuel injector plunger mechanism 22. In accordance with the structural arrangement of the mechanism or system 110, the cam shaft 160 is disposed adjacent to or within the vicinity of the exhaust rocker arm 182 and the cam shaft 184. Therefore, the cam shaft 160, the cam shaft 184, and the exhaust rocker arm 182 are all disposed upon the same side of the fuel injector 112 and the fuel injector plunger mechanism 122.

In addition, in lieu of the axially oriented passage or through-slot 42, within which the fuel injector plunger mechanism 22 and the plunger return spring 24 are axially disposed, being defined or provided within a central portion of the brake rocker 40, an axially oriented passage or through-slot 142 is provided within the right side or right end portion 164 of the brake rocker arm 140 so as to accommodate the fuel injector plunger mechanism 122 and the plunger return spring 124. Still further, the cam shaft 160 is operatively engaged with the left side or left end portion 172 of the brake rocker arm 140. A biasing spring 168 is interposed the left side or left end portion 172 of the brake rocker arm 140. A recessed support portion 170 is defined within the cylinder head 120 so as to maintain the left side or left end portion 172 of the brake rocker arm 140 engaged with the cam shaft 160. The central portion of the brake rocker arm 140 is provided with a through-bore 174 for accommodating the passage therethrough of the adjustable braking rod 176.

Industrial Applicability

In operation during normal fuel injection of the internal combustion engine fueling and compression braking hydraulically actuated, electronically controlled unit injector (HEUI) mechanism or system 10, the electronic control module (ECM) 36 is energized. A signal is sent to the solenoid 34, activated which in turn controls the disposition of the injector control valve 32. The injector control valve 32 controls the flow of hydraulic fluid or oil to actuate the fuel injector piston 30. The fuel injector piston 30 actuates the fuel injector plunger mechanism 22 so as to achieve fuel injection. The space 58 between the upper end portion 56 of the fuel injector piston 30 and the upper end portion 54 of the brake actuation sleeve 46, as well as the provision of the through-passage or slot 42 within the brake rocker arm 40, the upward and downward movements of the fuel injector piston 30 and the fuel injector plunger mechanism 22 can occur without any interference being encountered with the brake rocker arm 40 or the brake actuation sleeve 46.

Alternatively, when engine compression braking is desired, the electronic control module (ECM) 36 transmits a signal to the solenoid 34 for controlling the injector control valve 32, and in turn the fuel injector piston 30, in accordance with engine compression braking timing and duration. Simultaneously with the transmission of the signal to the solenoid 34, the electronic control module (ECM) 36 also transmits a signal to the servomechanism or the like, not shown, operatively associated with the cam shaft 60 by signal line 62.

As a result of such signal the cam shaft 60 is pivoted or rotated. For example, through an angle of 90 degrees, such that in lieu of the flattened or planar surface portion 66 of the cam shaft 60 being disposed in contact or engagement with the right end portion 64 of the brake rocker arm 40, the curved cam surface of the cam shaft 60 is disposed in contact or engagement with the right end portion 64 of the brake rocker arm 40. As a result of this altered disposition of the cam shaft 60, the right end portion 64 and the central portion of the brake rocker arm 40 are elevated with respect to the left end portion 72 of the brake rocker arm 40. This serves as a pivotal fulcrum as a result of the left end portion 72 of the brake rocker arm 40 being seated upon the head or collar portion 78 of the adjustable braking rod 76. The left end portion 72 of the brake rocker arm 40 cannot move lower at this stage because it is seated upon the head or collar portion 78 of the adjustable braking rod 76. The adjustable braking rod 76 is prevented from moving axially lower in view of the axial disposition of the adjustable braking rod 76. The adjustable braking rod 76 is in effect fixed by the nut 96 which is seated upon the right end portion 93 of the exhaust valve rocker arm 82. The right end portion 93 of the exhaust valve rocker arm 82 is also disposed at its elevated position as a result of the cam shaft 84 being disposed at a relative rotational position. At this stage, this does not cause the exhaust valve rocker arm 82 to pivot in the clockwise direction. Accordingly, the right end portion 93 of the exhaust valve rocker arm 82 is disposed at its elevated position as a result of being acted upon by the collar 90 and the exhaust valve return spring 88.

As a result of the elevation of the right end portion 64 of the brake rocker arm 40, and in particular, as a result of the elevation of the central portion 48 of the brake rocker arm 40, the brake actuation sleeve 46, which is seated atop the central portion 48 of the brake rocker arm 40, is elevated such that the uppermost end portion 54 of the brake actuation sleeve 46 will now be nearly engaged with the base portion 56 of the fuel injector piston 30. As a result of this relative disposition defined between the brake actuation sleeve 46 and the fuel injector piston 30, when the electronic control module (ECM) 36 sends the signal to the solenoid 34 for controlling the injector control valve 32, and in turn the fuel injector piston 30, in accordance with engine compression braking timing and duration, the fuel injector piston 30 will be moved downwardly. Accordingly, as a result of the noted engagement or contact defined between the fuel injector piston 30 and the brake actuation sleeve 46, the brake actuation sleeve 46 will also be moved downwardly.

The downward movement of the brake actuation sleeve 46 causes the brake rocker arm 40 to tend to move lower or downwardly. However, since the right end portion 64 of the brake rocker arm 40 is in effect fixed as a result of being engaged with the curved portion of the cam shaft 66, and since the cam shaft 66 is seated atop or otherwise vertically fixed in position with respect to the cylinder head 20, the only way that the brake rocker arm 40 can in effect move lower or downwardly is for the central and left end portions 48, 72 of the brake rocker arm 40 to in effect pivot or rotate in a counterclockwise manner with respect to the right end portion 64 of the brake rocker arm 40. This position serves as a fulcrum as a result of being seated upon and engaged with the camshaft 60. The downward or lowered movement of the left end portion 72 of the brake rocker arm 40 causes a clockwise pivotal or rotational movement of the exhaust valve rocker arm 82. The connection defined between the adjustable braking rod 76 and the exhaust valve rocker arm 82 causes downward movement and consequent opening of the engine exhaust valve 16 through the connection defined between the exhaust valve rocker arm 82 and the valve stem 92. Compression braking is therefore able to be achieved. As a result of the disposition of the stop member 98 upon the cylinder head 20, collar or head portion 78 of the adjustable braking rod 76 will encounter the same so as to predeterminedly limit the downward movement of the adjustable braking rod 76. And the disposition of the stop member 98 results in the pivotal movement of the brake rocker arm 40, the pivotal movement of the exhaust valve rocker arm 82, and the downward or opening movement of the engine exhaust valve 16.

In a similar manner, in connection with the operation of another embodiment of the internal combustion engine fueling and compression braking hydraulically actuated, electronically controlled unit injector (HEUI) mechanism or system 110, normal fuel injection operation of this embodiment is similar to that of the embodiment previously discussed. The operation of the system 110 of this embodiment is essentially the same as that of the system 10 of the other embodiment. Although the actual movements and disposition of the various structural components of the system 110 of this embodiment are different with respect to the corresponding components of the system 10 of the other embodiment.

When compression braking is to be initiated, the electronic control module (ECM) 136 sends a signal to the servomechanism or the like, not shown, controlling the cam shaft 160. The cam shaft 160 is rotated or pivoted such that the flattened surface 166 of the shaft 160 is no longer in contact with the left end portion 172 of the brake rocker arm 140. Accordingly, the left end portion 172 of the brake rocker arm 140 is caused to move downwardly against the biasing force of the spring 168. And since the adjustable braking rod 176 is in effect positionally fixed in a vertical or axial mode for the same reasons that the adjustable braking rod 76 of the first embodiment was similarly fixed at this stage. The brake rocker arm 140 is caused to be pivoted or rotated in the counterclockwise direction, thus, the right end portion 164 of the brake rocker arm 140 is, in effect, moved upwardly. As a result of such upward movement of the right end portion 164 of the brake rocker arm 140, brake actuation sleeve 146 is moved upwardly such that the uppermost or distal end portion 154 is disposed into close engagement with the base or transverse portion 156 of the fuel injector piston 130.

Consequently, the electronic control module (ECM) 136 sends a signal to the solenoid 134 so as to initiate compression braking and control. The actuation of the injector control valve 132 which, in turn, controls the actuation of the fuel injector piston 130, downward movement of the fuel injector piston 130 will cause downward movement of the brake actuation sleeve 146. As a result of the engagement of the brake actuation sleeve 146 with the right end portion 164 of the brake rocker arm 140, the right end portion 164 of the brake rocker arm 140 is caused to move downwardly. Since the left end portion 172 of the brake rocker arm 140 is in effect vertically or elevationally fixed by the disposition of the cam shaft 160, and more particularly as a result of the aforenoted engagement of the curved portion of the cam shaft 160 with the left end portion 172 of the brake rocker arm 140, the left end portion 172 of the brake rocker arm 140 now serves as the pivot point or fulcrum about which the brake rocker arm 140 is pivoted or rotated in the clockwise direction. Such pivotal or rotational movement of the brake rocker arm 140 causes the downward or lowered movement of the adjustable braking rod 176. As a result of the engagement of the collar or head portion 178 of the adjustable braking rod 176 with the brake rocker arm 140, the exhaust valve rocker arm 182 is caused to be pivoted or rotated in the clockwise direction. This movement of the exhaust valve rocker arm 182 causes downward or lowered movement of the exhaust valve stem 192. Thus, the exhaust valve 116 is opened so as to achieve compression braking. Downward movement of the adjustable braking rod 176 is noted as being limited as a result of the engagement of the head or collar portion 178 of the adjustable braking rod 176 with the stop member 198 formed upon the cylinder head 120.

Thus, it may be seen that in accordance with the teachings and principles of the present invention, the fuel injector piston is utilized to achieve normal fuel injection and is also used to control the actuation of the engine exhaust valve in conjunction with the achievement of engine compression braking such that additional or auxiliary structural components, such as pumps or similar pumping mechanisms, are not required whereby the cost of the engine compression braking may be contained.

Other aspects, objects and advantages of this invention can be obtained from a study of the drawings, the disclosure and the appended claims.

What is claimed is:

1. An internal combustion engine fueling and compression braking system, comprising:

an engine cylinder;

a fuel injector for injecting fuel into said engine cylinder so as to be combusted;

a fuel injector piston for causing pressurization of fuel to be delivered to said fuel injector;

an exhaust valve operatively associated with said engine cylinder for controlling the exhaust of gaseous products from said engine cylinder;

an exhaust valve rocker arm operatively connected to said exhaust valve so as to control opening of said exhaust valve when exhaust of gaseous products from said engine cylinder is desired;

a compression brake actuating system for operatively interconnecting said piston to said exhaust valve rocker arm; and a control system operatively connected to said compression brake actuating system for alternatively disposing said compression brake actuating system in two different modes wherein when said compression brake actuating system is disposed in a first one of said two different modes, said compression brake actuating system is operatively disconnected from said piston such that movement of said piston causes normal engine fuel injection to occur, and wherein when said compression brake actuating system is disposed in a second one of said two different modes, said compression brake actuating system is operatively connected to said piston such that movement of said piston causes said compression brake actuating system to actuate said exhaust valve rocker arm so as to in turn actuate said exhaust valve such that compression braking can occur.

2. The system as set forth in claim 1, including an injector control valve for fluidically controlling said fuel injector piston, a solenoid for controlling operation of said injector control valve, and an electronic control module (ECM) for transmitting a signal to said solenoid for actuating said solenoid so as to control said injector control valve when both engine fuel injection and engine compression braking modes are to be initiated.

3. The system as set forth in claim 1 wherein said compression brake actuating system includes a brake rocker arm, a brake actuation sleeve mounted upon said brake rocker arm and operatively engageable with said piston when said compression brake actuating system is disposed in said second one of said two different modes, and an adjustable braking rod interconnecting said brake rocker arm to said exhaust valve rocker arm.

4. The system as set forth in claim 3, wherein said fuel injector has a transversely oriented bore defined therein, and said brake rocker arm extends through said transversely oriented bore defined within said fuel injector.

5. The system as set forth in claim 3 including an injector control valve for fluidically controlling said fuel injector piston, a solenoid for controlling operation of said injector control valve, and an electronic control module (ECM) for transmitting a signal to said solenoid for actuating said solenoid so as to control said injector control valve when both engine fuel injection and engine compression braking modes are to be initiated.

6. The system as set forth in claim 5 wherein said control system includes a cam shaft operatively connected to said electronic control module (ECM) and operatively engaged with said brake rocker arm for moving said brake rocker arm, in response to an electrical signal received from said electronic control module (ECM), such that said brake actuation sleeve is engaged with said fuel injector piston whereupon actuation of said fuel injector piston, said brake rocker arm causes said exhaust valve rocker arm to actuate said exhaust valve to its open position so as to achieve engine compression braking.

7. The system as set forth in claim 3 wherein said fuel injector piston has a substantially inverted cup-shaped configuration, a fuel injector plunger is operatively connected to said fuel injector piston, and said brake actuation sleeve includes a tubular member radially interposed said fuel injector plunger and said fuel injector piston such that said brake actuation sleeve surrounds a portion of said fuel injector plunger and is encompassed within said fuel injector piston.

8. The system as set forth in claim 7 wherein said brake rocker arm has an axially oriented passage defined therein, said fuel injector plunger has a return spring operatively connected thereto, and said fuel injector plunger and said return spring are housingly accommodated within said axially oriented passage defined within said brake rocker arm.

9. The system as set forth in claim 8, wherein said axially oriented passage is defined within a central portion of said brake rocker arm, said adjustable braking rod is operatively connected to a first end portion of said brake rocker arm, and said control system includes a cam shaft operatively engaged with a second opposite end of said brake rocker arm for moving said brake rocker arm such that said brake actuation sleeve is engaged with said fuel injector piston whereupon actuation of said fuel injector piston, said brake rocker arm causes said exhaust valve rocker arm to actuate said exhaust valve to its open position so as to achieve engine compression braking.

10. The system as set forth in claim 8 wherein said axially oriented passage is defined within a first end portion of said brake rocker arm, said adjustable braking rod is operatively connected to a central portion of said brake rocker arm, and said control system includes a cam shaft operatively engaged with a second opposite end of said brake rocker arm for moving said brake rocker arm such that said brake actuation sleeve is engaged with said fuel injector piston whereupon actuation of said fuel injector piston, said brake rocker arm causes said exhaust valve rocker arm to actuate said exhaust valve to its open position so as to achieve engine compression braking.

11. An internal combustion engine fueling and compression braking system, comprising:

an engine cylinder;

a fuel injector for injecting fuel into said engine cylinder so as to be combusted;

a piston for causing pressurization of fuel to be delivered to said fuel injector;

an exhaust valve operatively associated with said engine cylinder for controlling the exhaust of gaseous products from said engine cylinder;

an exhaust valve rocker arm operatively connected to said exhaust valve so as to control opening of said exhaust valve when exhaust of gaseous products from said engine cylinder is desired; and a compression brake actuating system operatively connected to said exhaust valve rocker arm and being alternatively disposable in two different modes wherein when said compression brake actuating system is disposed in a first one of said two different modes, said compression brake actuating system is operatively disconnected from said piston such that movement of said piston causes normal engine fuel injection to occur, and wherein when said compression brake actuating system is disposed in a second one of said two different modes, said compression brake actuating system is operatively connected to said piston such that movement of said piston causes said compression brake actuating system to actuate said exhaust valve rocker arm so as to in turn actuate said exhaust valve such that compression braking can occur.

12. The system as set forth in claim 11 including an injector control valve for fluidically controlling said fuel injector piston, a solenoid for controlling operation of said injector control valve, and an electronic control module (ECM) for transmitting a signal to said solenoid for actuating said solenoid so as to control said injector control valve when both engine fuel injection and engine compression braking modes are to be initiated.

13. The system as set forth in claim 11, wherein said compression brake actuating system includes a brake rocker arm, a brake actuation sleeve mounted upon said brake rocker arm and operatively engageable with said piston when said compression brake actuating system is disposed in said second one of said two different modes, and an adjustable braking rod interconnecting said brake rocker arm to said exhaust valve rocker arm.

14. The system as set forth in claim 13 wherein said fuel injector has a transversely oriented bore defined therein, and said brake rocker arm extends through said transversely oriented bore defined within said fuel injector.

15. The system as set forth in claim 13, including an injector control valve for fluidically controlling said fuel injector piston, a solenoid for controlling operation of said injector control valve, and an electronic control module (ECM) for transmitting a signal to said solenoid for actuating said solenoid so as to control said injector control valve when both engine fuel injection and engine compression braking modes are to be initiated.

16. The system as set forth in claim 13 wherein said fuel injector piston has a substantially inverted cup-shaped configuration, a fuel injector plunger is operatively connected to said fuel injector piston, and said brake actuation sleeve includes a tubular member radially interposed said fuel injector plunger and said fuel injector piston such that said brake actuation sleeve surrounds a portion of said fuel injector plunger and is encompassed within said fuel injector piston.

17. The system as set forth in claim 16 wherein said brake rocker arm has an axially oriented passage defined therein, said fuel injector plunger has a return spring operatively connected thereto, and said fuel injector plunger and said return spring are housingly accommodated within said axially oriented passage defined within said brake rocker arm.

18. The system as set forth in claim 17 wherein said axially oriented passage is defined within a central portion of said brake rocker arm, said adjustable braking rod is operatively connected to a first end portion of said brake rocker arm, and a camming shaft is operatively engaged with a second opposite end of said brake rocker arm for moving said brake rocker arm such that said brake actuation sleeve is engaged with said fuel injector piston whereupon actuation of said fuel injector piston, said brake rocker arm causes said exhaust valve rocker arm to actuate said exhaust valve to its open position so as to achieve engine compression braking.

19. The system as set forth in claim 17 wherein said axially oriented passage is defined within a first end portion of said brake rocker arm, said adjustable braking rod is operatively connected to a central portion of said brake rocker arm, and a cam shaft is operatively engaged with a second opposite end of said brake rocker arm for moving said brake rocker arm such that said brake actuation sleeve is engaged with said fuel injector piston whereupon actuation of said fuel injector piston, said brake rocker arm causes said exhaust valve rocker arm to actuate said exhaust valve to its open position so as to achieve engine compression braking.

* * * * *